US011561054B2

(12) United States Patent
Nitzken

(10) Patent No.: US 11,561,054 B2
(45) **Date of Patent: *Jan. 24, 2023**

(54) CLEANING TUBESHEETS OF HEAT EXCHANGERS

(71) Applicant: Thermal Engineering International (USA) Inc., Cerritos, CA (US)

(72) Inventor: Joseph A. Nitzken, Louisville, KY (US)

(73) Assignee: Thermal Engineering International (USA) Inc., Santa Fe Springs, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/701,379

(22) Filed: Dec. 3, 2019

(65) Prior Publication Data

US 2020/0103186 A1 Apr. 2, 2020

Related U.S. Application Data

(62) Division of application No. 15/019,389, filed on Feb. 9, 2016, now Pat. No. 10,502,510.

(51) Int. Cl.
*F28G 3/16* (2006.01)
*B08B 9/00* (2006.01)
(Continued)

(52) U.S. Cl.
CPC ..... *F28G 3/163* (2013.01); *B08B 3/02* (2013.01); *B08B 9/00* (2013.01); *F28B 1/02* (2013.01);
(Continued)

(58) Field of Classification Search
CPC . F28G 1/16; F28G 1/163; F28G 1/166; F28G 9/00; F28G 1/00; B08B 3/02;
(Continued)

(56) References Cited

U.S. PATENT DOCUMENTS 1,589,980 A 6/1926 Willard et al.
1,807,457 A * 5/1931 Weis ..... F28G 1/163 165/95
(Continued)

FOREIGN PATENT DOCUMENTS

CN 85106441 A 3/1987
DE 344141 C * 11/1921 ..... F28G 1/163
(Continued)

OTHER PUBLICATIONS

International Preliminary Report on Patentability and Written Opinion of the International Searching Authority dated Aug. 23, 2018, issued during the prosecution of corresponding PCT International Patent Application No. PCT/US2017/015968.

*Primary Examiner* — Jianying C Atkisson
*Assistant Examiner* — For K Ling
(74) *Attorney, Agent, or Firm* — Locke Lord LLP; Joshua L. Jones; Gabrielle L. Gelozin

(57) ABSTRACT

A heat exchange system includes a shell having an interior with an inlet and an outlet wherein a first fluid circuit is defined from the inlet, through a heat exchange volume within the interior of the shell, to the outlet. A tubesheet is mounted within the shell dividing between the heat exchange volume and a plenum of a second fluid circuit within the interior of the shell. A set of tubes extends through the heat exchange volume, a respective interior passage of each tube being in fluid communication with the plenum through a respective opening though the tubesheet. The second fluid circuit includes the plenum and interior passages of the tubes. A spray nozzle is mounted in the plenum of the second fluid circuit with a spray outlet directed toward the tubesheet for cleaning the tubesheet with a submerged impingement jet issued from the spray nozzle.

8 Claims, 2 Drawing Sheets

(51) Int. Cl.

| | |
|---|---|
| ***B08B 3/02*** | (2006.01) |
| ***F28B 1/02*** | (2006.01) |
| ***F28D 7/16*** | (2006.01) |
| ***F28F 9/013*** | (2006.01) |
| ***F28G 15/00*** | (2006.01) |

(52) U.S. Cl.
CPC ..... *F28D 7/16* (2013.01); *F28F 9/0131* (2013.01); *F28G 3/16* (2013.01); *F28G 15/003* (2013.01)

(58) Field of Classification Search
CPC ..... F28D 7/16; F28F 9/0131; F04F 29/0092; F04F 2210/221; F04F 2210/1005
USPC ..... 165/95
See application file for complete search history.

(56) References Cited

U.S. PATENT DOCUMENTS

| | | | | |
|---|---|---|---|---|
| 1,930,515 | A | | 10/1933 | Eby |
| 2,801,824 | A | | 8/1957 | Josef et al. |
| 3,045,978 | A | | 7/1962 | Waldhofer |
| 3,123,132 | A | | 3/1964 | Hedgecock et al. |
| 3,473,961 | A | | 10/1969 | Maschf et al. |
| 3,637,138 | A | | 1/1972 | Rucker |
| 4,234,993 | A | | 11/1980 | Kintner |
| 4,276,856 | A | | 7/1981 | Dent et al. |
| 4,476,917 | A | * | 10/1984 | Otake ..... F28G 1/12 165/95 |
| 4,492,186 | A | | 1/1985 | Helm |
| 4,498,427 | A | | 2/1985 | Todd |
| 4,505,128 | A | * | 3/1985 | Miller ..... A61M 16/10 62/272 |
| 4,715,324 | A | | 12/1987 | Muller et al. |
| 4,750,547 | A | * | 6/1988 | Sakamoto ..... F28G 9/00 122/390 |
| 4,905,900 | A | * | 3/1990 | Scharton ..... F22B 37/483 122/382 |
| 5,083,606 | A | | 1/1992 | Brown et al. |
| 5,092,280 | A | | 3/1992 | Franklin et al. |
| 5,137,081 | A | * | 8/1992 | Klaren ..... F28G 1/12 15/3.5 |
| 5,238,502 | A | | 8/1993 | Jenkins |
| 5,555,851 | A | | 9/1996 | Vandenberg |
| 5,782,255 | A | | 7/1998 | Magnin et al. |
| 6,609,531 | B2 | | 8/2003 | Lesko |
| 6,672,257 | B1 | | 1/2004 | Ashton, III et al. |
| 6,907,847 | B2 | | 6/2005 | Bartels et al. |
| 7,846,260 | B2 | | 12/2010 | Jiang et al. |
| 7,967,918 | B2 | | 6/2011 | Collin et al. |
| 8,646,514 | B2 | | 2/2014 | Ni |
| 2006/0185691 | A1 | | 8/2006 | Joseph |
| 2009/0010378 | A1 | | 1/2009 | Haberman |
| 2011/0180022 | A1 | | 7/2011 | Hawkins et al. |
| 2013/0312794 | A1 | | 11/2013 | Al-Otaibi et al. |
| 2014/0158169 | A1 | | 6/2014 | Hays |

FOREIGN PATENT DOCUMENTS

| | | | | |
|---|---|---|---|---|
| EP | 0132112 | A2 | | 1/1985 |
| EP | 0169420 | A1 | | 1/1986 |
| EP | 0175563 | A1 | | 3/1986 |
| EP | 0265549 | A1 | | 5/1988 |
| EP | 0339288 | A1 | | 11/1989 |
| EP | 0422267 | A1 | | 4/1991 |
| EP | 0435486 | A2 | | 7/1991 |
| FR | 2568985 | A1 | | 2/1986 |
| FR | 3002166 | A1 | | 8/2014 |
| JP | 09229591 | A | * | 9/1997 ..... F28F 19/00 |
| WO | 9708107 | A1 | | 3/1997 |
| WO | 2008005870 | A2 | | 1/2008 |
| WO | 2011078916 | A2 | | 6/2011 |
| WO | 2014158377 | A1 | | 10/2014 |

* cited by examiner

CLEANING TUBESHEETS OF HEAT EXCHANGERS

CROSS-REFERENCE TO RELATED APPLICATIONS

This is a divisional of U.S. patent application Ser. No. 15/019,389 filed Feb. 9, 2016, now U.S. Pat. No. 10,502,510 granted Dec. 10, 2019, which is incorporated by reference herein in its entirety.

BACKGROUND OF THE INVENTION

1. Field of the Invention

The present disclosure relates to heat exchangers, condensers, and the like, and more particularly to systems and methods for cleaning tubesheets in heat exchangers, condensers, and the like, e.g., while operating or shutdown without requiring disassembly.

2. Description of Related Art

Shell and tube heat exchangers can be used for exchanging heat between a first fluid in the shell, and a second fluid in the tubes passing through the shell. This arrangement can be used simply for heat exchange, but one specific application is in condensers such as used in steam powered systems. In such an application, spent steam enters the shell and flows over the tubes. There is a cool flow of water or other coolant passing through the tubes, and as heat transfers from the steam into the water through the tube walls, the steam condenses into the bottom of the shell or hotwell. Condensate from the bottom of the shell can then be recycled through the steam cycle in a closed system, or discharged into the environment in an open system.

Typically the water passing through the cooling tubes is not distilled or purified water. Instead, it is common to use sea water, river water, or water otherwise drawn from the environment. Impurities and entities such as minerals, algae, biological organisms, and the like, can deposit themselves and can accumulate within the heat exchanger tubes, and on the tubesheets at the entrance and exit of the tubes.

The accumulation of these deposits, known as fouling, in the tubes and tubesheets must be addressed or else the performance of the heat exchanger will diminish. In a steam powered plant, a shutdown of three or more days may be required in order to remove the deposits from the tubes and tubesheets. Some solutions to this problem have been used, such as systems that employ sponge ball cleaners that circulate through the tubes. While such systems may allow for cleaning in line with operation of the heat exchanger, they inevitably add complexity issues to the operation.

Such conventional methods and systems have generally been considered satisfactory for their intended purpose. However, there is still a need in the art for improved cleaning of heat exchangers, condensers, and the like. The present disclosure provides a solution for this need.

SUMMARY OF THE INVENTION

A heat exchange system includes a shell having an interior with an inlet and an outlet wherein a first fluid circuit is defined from the inlet, through a heat exchange volume within the interior of the shell, to the outlet. A tubesheet is mounted within the shell dividing between the heat exchange volume and a plenum of a second fluid circuit within the interior of the shell. A set of tubes extend through the heat exchange volume, a respective interior passage of each tube being in fluid communication with the plenum through a respective opening though the tubesheet. The second fluid circuit includes the plenum and interior passages of the tubes. A spray nozzle or bank of nozzles is mounted in the plenum of the second fluid circuit with a spray outlet directed toward the tubesheet for cleaning the tubesheet with a submerged impingement jet issued from the spray nozzle(s). The spray nozzle(s) is/are configured to operate both during heat exchanger operation and/or when the heat exchanger is not operating.

The spray nozzle can include a mechanism configured to move the spray outlet through a procession of angles relative to the tubesheet to move the impingement jet over a targeted area of the tubesheet. The mechanism can include at least one of vanes or driven gears for moving and directing the spray outlet in a spray pattern across the tubesheet under power of fluid passing through the spray nozzle. An inlet conduit can be connected in fluid communication with the plenum of the second fluid circuit for supplying fluid from an external source to the plenum, wherein a secondary conduit connects the spray nozzle in fluid communication with the inlet conduit for supplying fluid to be issued from the spray nozzle as the impingement jet. A pump or higher pressure source can be included in the secondary conduit for raising pressure in the fluid supplied to be issued from the spray nozzle, or if the source of fluid for the secondary conduit is at sufficient pressure no pump may be required. A filter can be included in the secondary conduit, e.g. upstream of the pump, to reduce or prevent impurities fouling the spray nozzle.

The spray nozzle can be a first spray nozzle in a plurality of spray nozzles mounted in the plenum, e.g. wherein the spray nozzles are all in fluid communication with the secondary conduit. The spray nozzles can be arranged in a pattern configured to provide cleaning sprays to clean the tube sheet completely on a plenum side thereof. The spray nozzles can be each operatively connected to a controller configured to activate and deactivate the spray nozzles individually.

The tubesheet can be a first tube sheet, the plenum can be a first plenum, and the spray nozzle can be a first spray nozzle. The system can include a second tubesheet mounted within the shell dividing between the heat exchange volume and a second plenum of the second fluid circuit within the interior of the shell, wherein each of the tubes extends between a respective opening in the first tubesheet and a respective opening in the second tubesheet for fluid communication between the first and second plena through the tubes. A second spray nozzle can be mounted in the second plenum with a spray outlet directed toward the second tubesheet for cleaning the second tubesheet with a submerged impingement jet issued from the second spray nozzle. A branch of the secondary conduit described above can connect the second spray nozzle in fluid communication with the inlet conduit for supplying fluid to be issued from the second spray nozzle.

A method of cleaning in a heat exchange system includes issuing a jet from a spray nozzle to impinge on a tubesheet within a shell of a heat exchanger to remove and/or prevent accumulations from the tubesheet, wherein the jet is submerged. Issuing the jet can include supplying fluid to the spray nozzle from a common source as fluid in a fluid circuit in which the jet is submerged. Issuing the jet can be performed during and in line with operation of the heat exchanger including heat exchange between a first fluid circuit through the shell of the heat exchanger and a second fluid circuit fluidly isolated from the first fluid circuit, wherein the jet is submerged in fluid flowing in the second fluid circuit. Issuing the jet can be performed intermittently during operation of the heat exchanger. Issuing the jet can include moving a spray outlet of the spray nozzle through a procession of angles relative to the tubesheet to move the impingement jet over an area of the tubesheet.

A method of retrofitting a heat exchange system includes installing a spray nozzle in an end cap of a heat exchanger shell so that the spray nozzle has a spray outlet directed toward a tubesheet mounted within the shell, wherein the tubesheet divides between the heat exchange volume of a first fluid circuit within the shell, and a plenum of a second fluid circuit through the shell. The method can include installing a second spray nozzle in a second end cap of a heat exchanger shell opposite the first end cap, so that the second spray nozzle has a spray outlet directed toward a second tubesheet mounted within the shell as described above. The nozzle or nozzles can be installed so as to allow nozzle removal. The method of retrofitting can include installing a secondary conduit as described above. The method can include installing at least one of a controller connected to the spray nozzle for activation and deactivation of the spray nozzle, a pump in the secondary conduit for pressurization of fluid supplied to the spray nozzle, and a filter in the second conduit upstream of the pump to reduce or prevent impurities fouling the spray nozzle.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
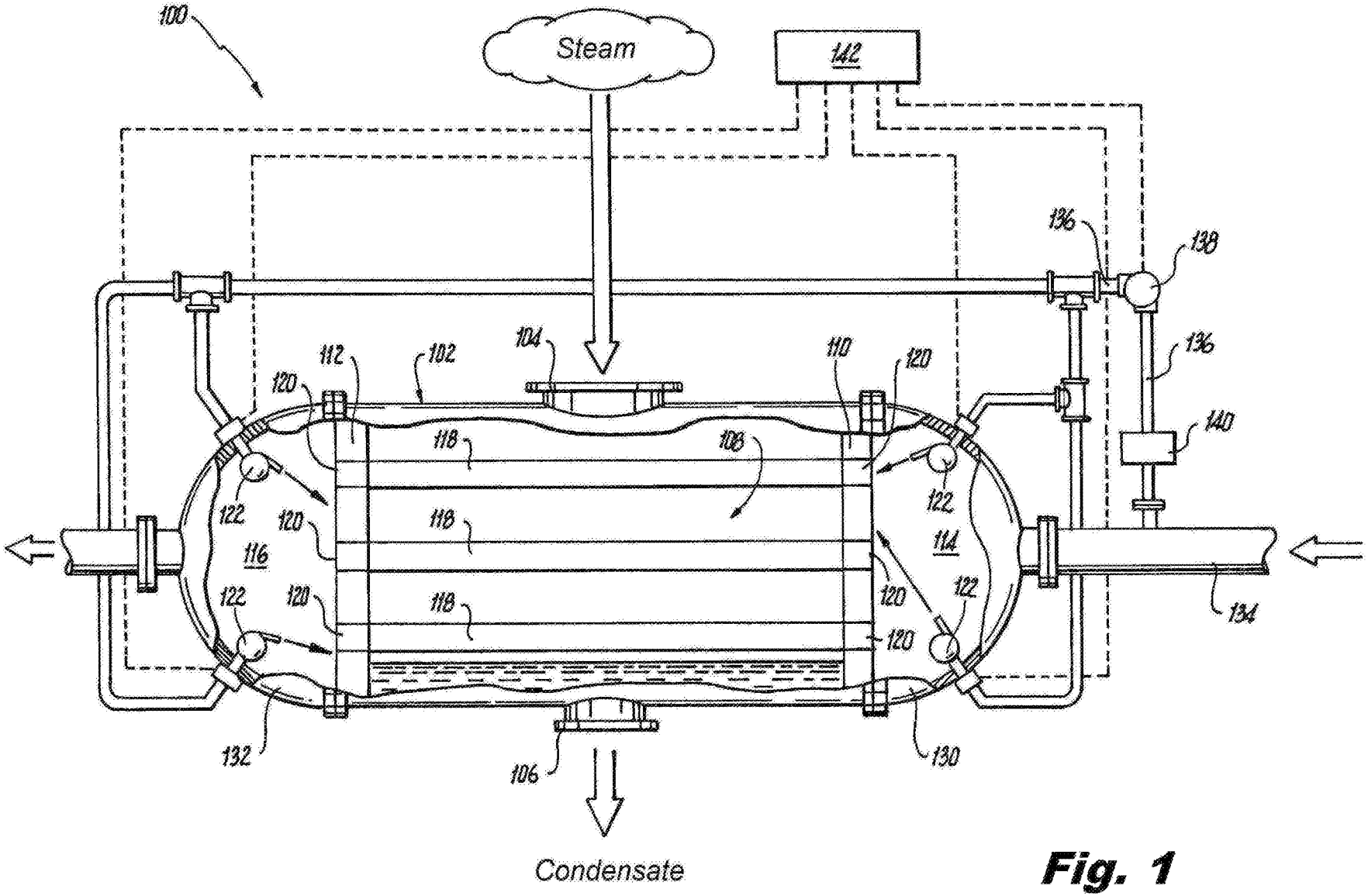
FIG. 1 is a schematic view of an exemplary embodiment of a system constructed in accordance with the present disclosure, showing the fluid circuits and submerged impingement jets cleaning the tubesheets.

Reference will now be made to the drawings wherein like reference numerals identify similar structural features or aspects of the subject disclosure. For purposes of explanation and illustration, and not limitation, a partial view of an exemplary embodiment of a system in accordance with the disclosure is shown in FIG. 1 and is designated generally by reference character 100. Other embodiments of systems in accordance with the disclosure, or aspects thereof, are provided in FIGS. 2-3, as will be described. The systems and methods described herein can be used for online and/or offline cleaning of tubesheets in heat exchangers such as condensers.

Heat exchange system 100 includes a shell 102 having an interior with an inlet 104 and an outlet 106 wherein a first fluid circuit is defined from the inlet 104, through a heat exchange volume 108 within the interior of the shell 102, to the outlet 106, as indicated by the large vertical arrows in FIG. 1. For example, in a condenser, steam enters inlet 104, and condensate issues from outlet 106. A pair of tubesheets 110 and 112 are mounted within the shell 102. Each of the tubesheet 110 and 112 divides between the heat exchange volume 108 and a respective plenum 114 and 116 of a second fluid circuit within the interior of the shell 102. A set of tubes 118 extends through the heat exchange volume 108. For sake of clarity in illustrating, only three tubes 118 are shown in FIG. 1; however those skilled in the art will readily appreciate that any suitable number of tubes 118 can be used without departing from the scope of this disclosure. A respective interior passage of each tube 118 is in fluid communication with each plenum 114 and 116 through a respective pair of openings 120 though the respective tubesheets 110 and 112. The second fluid circuit includes the plena 114 and 116 and the interior passages of the tubes 118, and flow through the second fluid circuit is indicated schematically in FIG. 1 by the large horizontal arrows. A plurality of spray nozzles 122 are mounted in the plena 114 and 116 of the second fluid circuit, each with a spray outlet 124 (shown in FIG. 2) directed toward the respective tubesheets 110 and 112 for cleaning the tubesheets 110 and 112 with a submerged impingement jet issued from the spray nozzles 122. The jets are indicated schematically in FIG. 1.

Figure 2:
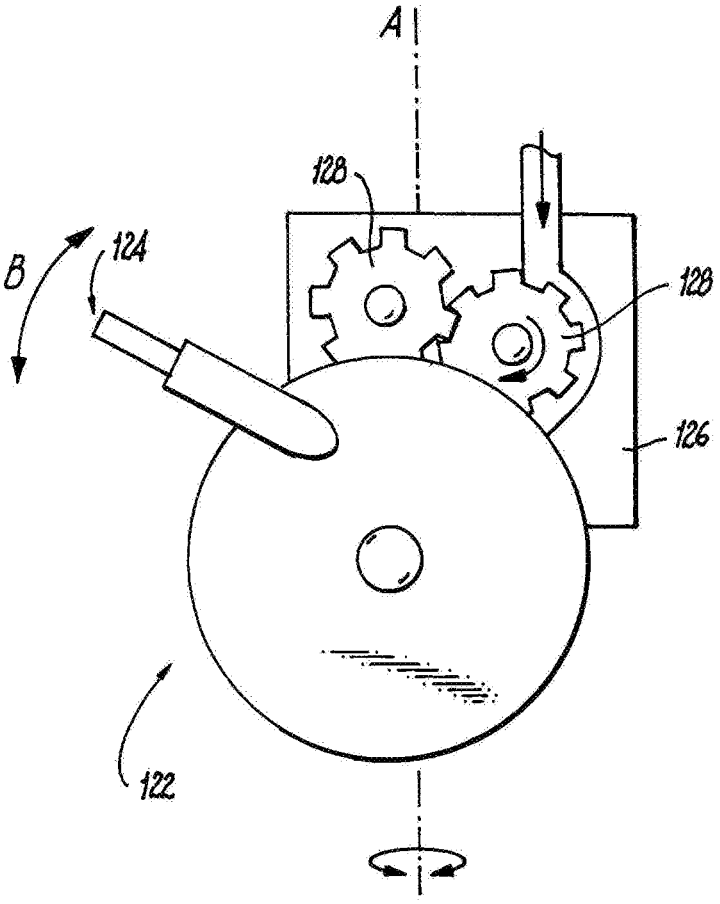
FIG. 2 is a schematic view of exemplary embodiment of a gear or vane driven type of one of the spray nozzles of FIG. 1, schematically indicating the fluid driven gear mechanism for driving the spray nozzle through a procession of spray angles.
Figure 3:
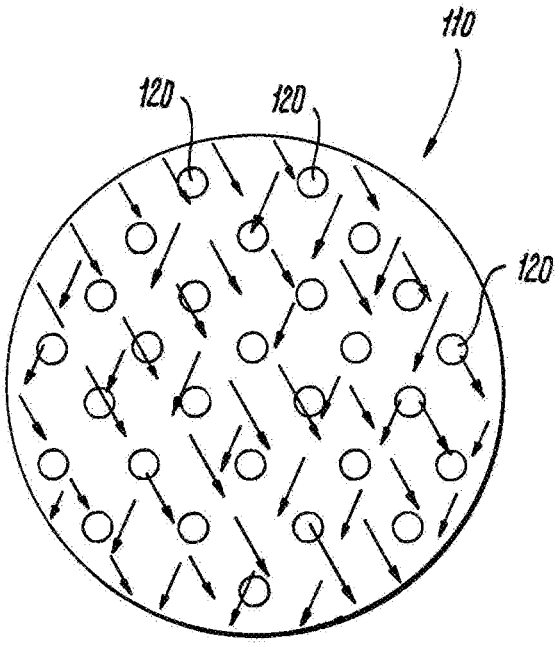
FIG. 3 is a schematic end view of one of the tubesheets of FIG. 1, showing an exemplary path of the impingement jet of the spray nozzle of FIG. 2 as it follows its procession of angles.

With reference now to FIG. 2, one of the spray nozzles 122 is shown in greater detail. The spray nozzle 122 includes a mechanism 126 configured to move the spray outlet 124 through a procession of angles relative to the respective tubesheet 110 or 112 to move the impingement jet over an area of the tubesheet 110 or 112. For example, the mechanism 126 can be configured to move spray outlet 124 in two directions, e.g. along the direction B and about the axis A. The mechanism 126 includes fluid driven vanes and/or gears 128 for moving the spray outlet 124 under power of fluid passing through the spray nozzle 122. Thus no power source is needed for movement of the spray nozzles 122 beyond the fluid itself flowing through spray nozzles 122. FIG. 3 schematically shows an exemplary spray pattern produced by the impingement jet moving about the surface of tubesheet 110 as spray outlet 124 undergoes its procession. Those skilled in the art will readily appreciate that the spray pattern shown in FIG. 3 is for purpose of example only, and that any suitable spray pattern or procession of angles can be used without departing from the scope of this disclosure.

An example of a spray nozzle with a fluid powered gear train is the IM 25 Nozzle available from Alfa Laval Inc of Richmond, Va. It should be noted that the IM 25 Nozzle includes two opposed spray outlets and it may be desirable in some applications to block off one of the spray outlets and/or modify the gear train to limit the angular procession so the impingement jet only traverses the tubesheet 110 or 112, not the inner surface of the respective end cap 130 or 132 or other non-tubesheet surfaces, which in some installations are coated with a tar or pitch type coating to prevent corrosion. Those skilled in the art will readily appreciate that the IM 25 Nozzle is only an example, and that any other suitable spray nozzle can be used without departing from the scope of this disclosure.

With reference again to FIG. 1, an inlet conduit 134 is connected to end cap 130 in fluid communication with the inlet plenum 114 of the second fluid circuit for supplying fluid from an external source to the inlet plenum 114. The external source can be any suitable source of fluid. For example, in a condenser application, the external source can include river water, sea water, or the like. A secondary conduit 136 connects the spray nozzles 122 in fluid communication with the inlet conduit 134 for supplying fluid to be issued from the spray nozzles 122 as the impingement jet. A pump 138 is included in the secondary conduit 136 for raising pressure in the fluid supplied to be issued from the spray nozzles 122. It is also contemplated that if the source of fluid for the secondary conduit is available at sufficient pressure, no pump 138 may be required. For example, in marine applications where sea water is used as the fluid of the second fluid circuit, pressurized fluid may be simply scooped from the flow of sea water around a vessel if the vessel is traveling at sufficient speed. Another example is if a city water supply is available at a higher pressure than the supply used as the fluid in the second fluid circuit, the secondary conduit could simply be tapped into or connected to the city water line, which in many cases has a higher pressure than the pressure at the secondary fluid circuit inlet for a condenser, for example. A filter 140 can be included in the secondary conduit 136, e.g., upstream of the pump 138, to reduce or prevent impurities fouling the spray nozzles 122.

The spray nozzles 122, e.g. two per plenum 114 and 116, are all in fluid communication with the secondary conduit 136 through respective branches of conduit 136. The spray nozzles 122 in each plenum are arranged in a pattern configured to provide cleaning sprays to clean the tube sheet 110 or 112 completely on a plenum side thereof. While two spray nozzles 122 per plenum 114 and 116 are shown and described in the exemplary embodiment, those skilled in the art will readily appreciate that any suitable number of spray nozzles can be included in a given plenum, including none or one, without departing from the scope of this disclosure. For example, it may be suitable in some applications to have a single spray nozzle 122 in the inlet plenum 114, and no spray nozzles in the outlet plenum 116.

The spray nozzles 122 and pump 138 are each operatively connected to a controller 142 configured to activate and deactivate the spray nozzles 122 individually, and to control pumping through pump 138. Controller 142 allows for controlling pump and spray nozzles 122 in accordance with the method described below. Any suitable control scheme can be used. For example, controller 142 can include one or more pressure regulator valves with timers, a touch screen or other user interface programmed system, a set of one or more manually operated valves, or any other suitable control scheme connected to activate/deactivate the one or more spray nozzles 122 together or individually.

A method of cleaning in a heat exchange system, e.g., heat exchange system 100, includes issuing a jet from a spray nozzle, e.g., spray nozzle 122, to impinge on a tubesheet, e.g., tubesheets 110 and 112, within a shell of a heat exchanger to remove accumulations from the tubesheet, wherein the jet is submerged while it is impinging on the tubesheet. Multiple spray nozzles and jets can be used. Issuing the jet can include supplying fluid to the spray nozzle from a common source as fluid in a fluid circuit in which the jet is submerged, e.g., wherein the fluid issued from spray nozzles 122 is from the same source as the rest of the fluid supplied into inlet plenum 114. Issuing the jet can therefore be performed during and in line with operation of the heat exchanger, i.e. online operation of the spray nozzles and heat exchanger, including heat exchange between a first fluid circuit through the shell of the heat exchanger and a second fluid circuit fluidly isolated from the first fluid circuit, wherein the jet is submerged in fluid flowing in the second fluid circuit. Issuing the jet can be performed intermittently during operation of the heat exchanger, e.g., by activating and deactivating spray nozzles 122 and/or pump 138 using controller 142. Issuing the jet includes moving a spray outlet of the spray nozzle through a procession of angles relative to the tubesheet to move the impingement jet over an area of the tubesheet, e.g., as shown in FIG. 3.

While it is contemplated that heat exchangers in new installations can benefit from the systems and methods disclosed herein, it is also contemplated that a heat exchange system can be retrofitted to benefit from the systems and methods described herein. A method of retrofitting includes installing one or more spray nozzles, e.g., spray nozzles 122, in an end cap of a heat exchanger shell, e.g., end caps 130 and 132, so that the spray nozzle has a spray outlet directed toward a tubesheet, e.g., tubesheets 110 and 112, mounted within the shell. The retrofit method can include installing one or more second spray nozzles in a second end cap of a heat exchanger shell opposite the first end cap, so that the second spray nozzle has a spray outlet directed toward a second tubesheet mounted within the shell as described above. The method of retrofitting can include installing a secondary conduit, e.g., secondary conduit 136 as described above. The method can include installing at least one of a controller, e.g., controller 142, connected to the spray nozzle for activation and deactivation of the spray nozzle, a pump, e.g., pump 138, in the secondary conduit for pressurization of fluid supplied to the spray nozzle, and a filter, e.g., filter 140, in the second conduit upstream of the pump to reduce or prevent impurities fouling the spray nozzle.

While shown and described in the exemplary context of a heat exchanger configured as a condenser, those skilled in the art will readily appreciate that the systems and methods disclosed herein can readily be applied to any other suitable type of heat exchanger tubesheet or submerged surface. For example, in food processing, it may be desirable to clean a tubesheet within a plenum using the same fluid, e.g. a food product such as milk or other liquid, that is flowing through the plenum itself.

The methods and systems of the present disclosure, as described above and shown in the drawings, provide for internal heat exchanger cleaning with superior properties including online and/or offline operation for reduced shutdown and improved system performance. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A method of cleaning in a heat exchange system comprising: issuing a jet of fluid from a spray nozzle to impinge on a tubesheet within a shell of a heat exchanger to remove accumulations from the tubesheet, wherein issuing the jet of fluid includes supplying the fluid to the spray nozzle from a common conduit of a fluid circuit supplying the fluid to the shell of the heat exchanger, wherein the jet is submerged in the fluid circuit, wherein the spray nozzles are moveably mounted within the fluid circuit such that issuing the jet includes moving a spray outlet of the spray nozzle through a procession of angles in a first direction about a first axis relative to the tubesheet and rotating in a second direction about a second axis different from the first axis relative to the tubesheet.

2. A method as recited in claim 1, wherein issuing the jet is performed during and in line with operation of the heat exchanger including heat exchange between a first fluid circuit through the shell of the heat exchanger and a second fluid circuit fluidly isolated from the first fluid circuit, wherein the jet is submerged in fluid flowing in the second fluid circuit.

3. A method as recited in claim 2, wherein issuing the jet is performed at least one of intermittently during operation of the heat exchanger or with the heat exchanger offline.

4. A method of retrofitting a heat exchange system comprising: installing a spray nozzle in an end cap of a heat exchanger shell so that the spray nozzle has a spray outlet directed toward a tubesheet mounted within the shell, wherein the tubesheet divides between the heat exchange volume of a first fluid circuit within the shell, and a plenum of a second fluid circuit through the shell, wherein the spray nozzle is configured to issue a jet of fluid from the spray nozzle outlet to impinge on the tubesheet, wherein the fluid in the second fluid circuit is supplied to the spray nozzle from a common conduit of the second fluid circuit, wherein the jet is submerged in the second fluid circuit, wherein the spray nozzles are moveably mounted within the fluid circuit such that issuing the jet includes moving a spray outlet of the spray nozzle through a procession of angles in a first direction about a first axis relative to the tubesheet and rotating in a second direction about a second axis different from the first axis relative to the tubesheet.

5. A method as recited in claim 4, wherein the spray nozzle is a first spray nozzle, the end cap is a first end cap, the plenum is a first plenum, and the tube sheet is a first tubesheet, further comprising:

installing a second spray nozzle in a second end cap of a heat exchanger shell opposite the first end cap, so that the second spray nozzle has a spray outlet directed toward a second tubesheet mounted within the shell, wherein the second tubesheet divides between the heat exchange volume of the first fluid circuit within the shell, and a second plenum of the second fluid circuit through the shell.

6. A method as recited in claim 4, further comprising:

installing a secondary conduit for fluid communication in the common conduit of the second fluid circuit.

7. A method as recited in claim 6, further comprising:

installing at least one of a controller connected to the spray nozzle for activation and deactivation of the spray nozzle, a pump in the secondary conduit for pressurization of fluid supplied to the spray nozzle, and a filter in the second conduit upstream of the pump to reduce or prevent impurities fouling the spray nozzle.

8. A method of cleaning in a heat exchange system comprising:

issuing a jet from a spray nozzle to impinge on a tubesheet within a shell of a heat exchanger to remove accumulations from the tubesheet, wherein the jet is submerged, wherein issuing the jet is performed during and in line with operation of the heat exchanger including heat exchange between a first fluid circuit through the shell of the heat exchanger and a second fluid circuit fluidly isolated from the first fluid circuit, wherein the jet is submerged in fluid flowing in the second fluid circuit, wherein issuing the jet includes moving a spray outlet of the spray nozzle through a procession of angles in a first direction relative to the tubesheet about a first axis and rotating in a second direction about a second axis different from the first axis, to move the impingement jet over an area of the tubesheet, and wherein neither of the first and second axes is fixed normal to the tubesheet.

* * * * *